US005524413A

United States Patent [19]

Fukuda

[11] Patent Number: 5,524,413

[45] Date of Patent: Jun. 11, 1996

[54] PACKAGING MACHINE WITH DEVICE FOR MONITORING REMAINING AMOUNT OF WEB IN A ROLL

[75] Inventor: Masao Fukuda, Shiga, Japan

[73] Assignee: Ishida Co., Ltd., Japan

[21] Appl. No.: 384,056

[22] Filed: Feb. 6, 1995

[30] Foreign Application Priority Data

Feb. 21, 1994 [JP] Japan ..... 6-046364
May 9, 1994 [JP] Japan ..... 6-120580

[51] Int. Cl.[6] ..... B65B 41/12; B65B 57/02; B65B 57/18

[52] U.S. Cl. ..... 53/64; 53/552; 53/389.2; 226/45; 226/100

[58] Field of Search ..... 53/64, 550, 551, 53/552, 389.2, 389.4, 51, 389.5; 226/10, 45, 100; 242/334.5, 334.4

[56] References Cited

U.S. PATENT DOCUMENTS

| | | | |
|---|---|---|---|
| 4,691,499 | 9/1987 | Umeda et al. | 53/389.4 X |
| 4,727,707 | 3/1988 | Hadden | 53/552 X |
| 5,272,853 | 12/1993 | Francioni et al. | 53/389.4 X |
| 5,279,098 | 3/1993 | Fukuda | 53/552 X |
| 5,280,274 | 3/1992 | Uemura . | |
| 5,328,072 | 7/1994 | Ruessmann et al. | 226/45 X |
| 5,388,387 | 2/1995 | McElvy | 53/389.2 X |
| 5,400,980 | 3/1995 | Yoshikawa | 242/334.5 X |

FOREIGN PATENT DOCUMENTS

| | | | |
|---|---|---|---|
| 171345 | 8/1984 | European Pat. Off. . | |
| 54-113577 | 5/1979 | Japan | 226/100 |
| 1-110467 | 10/1987 | Japan . | |
| 63-242857 | 10/1988 | Japan | 226/10 |

*Primary Examiner*—Horace M. Culver
*Attorney, Agent, or Firm*—Majestic, Parsons, Siebert & Hsue

[57] ABSTRACT

A monitoring device is used for a web roll which is rotated so as to unwind a web therefrom, for example, for making bags for a packaging machine. The speed of rotation of the web roll is detected by a revolution counter or an eye-mark sensor if the web is provided with eye-marks, and the current outer radius of the web roll is calculated from the detected speed of rotation as well as inputted data such as the length of the web required for making a bag and the number of bags being produced per unit time. The length of the web remaining in the web roll and other related data can be calculated and displayed either all at once or selectably in response to the user's instruction. An alarm signal may be outputted when the calculated outer radius of the web roll becomes small enough according to a preset criterion.

20 Claims, 5 Drawing Sheets

PRESENT CONDITION

1. OUTER RADIUS R mm
2. REMAINING LENGTH L m
3. NUMBER OF BAGS THAT CAN BE MADE $f$ bags 1. OUTER RADIUS mm
2. REMAINING LENGTH m
3. NUMBER OF BAGS THAT CAN BE MADE bags

SPECIFY THE NUMBER FOR ITEM TO BE DISPLAYED.

PACKAGING MACHINE WITH DEVICE FOR MONITORING REMAINING AMOUNT OF WEB IN A ROLL

BACKGROUND OF THE INVENTION

This invention relates to packaging machines of the form-fill-seal type using a web of flexible thermoplastic film in the form of a roll and adapted to unwind the film from the roll to form it into a cylindrical tubular shape and thermally seal it after objects to be packaged are deposited inside. This invention relates more particularly to devices adapted to be used in connection with a packaging machine of this type for displaying the amount of the web currently remaining in the roll or outputting an alarm signal for indicating that the roll which is currently being used will be used up within a specified short period of time, as well as packaging machines incorporating such devices.

Packaging machines, for example, of a vertical pillow type as disclosed in U.S. Pat. Nos. 5,279,098 issued Jan. 18, 1994 and 5,347,795 issued Sep. 20, 1994 (which are herein incorporated by reference) carry a rolled web of an elongated film and are adapted to form the film into a cylindrical shape and to seal it transversely as objects to be packaged are dropped inside. When such a packaging machine is being operated, it is important to be able to predict at each moment how much film still remains in the roll thereon or how many packaged products can still be formed before the web in the roll currently installed thereon will be used up. Because the user will have to supply a new roll or stop the operation of the packaging machine for this purpose, it is also important for the user to be warned when the end approaches of the roll currently being used.

Japanese Patent Publication Tokko 5-305 disclosed a device for calculating the time required for using up a currently installed web roll from its current radius and the time required for it to make one complete rotation as the web is being pulled out thereof. Such a device, however, would require not only a non-contact sensor for detecting the radius of the web roll but also adjustments of the sensor such that it will function properly all the time. Moreover, the user with such a device cannot predict how much web still remains in the roll or how many products can still be made from the web of film remaining in the roll.

SUMMARY OF THE INVENTION

It is therefore an object of this invention to provide a new device for predicting the end of a web roll or displaying the amount of the web still remaining in the web roll without the necessity of detecting its outer radius but simply from its speed of rotation and some preliminarily inputted data.

It is another object of the invention to provide a packaging machine incorporating such a new device.

A warning device according to this invention, with which one or more of the above and other objects can be accomplished, may be characterized as comprising a detector means for detecting the speed of rotation of the web roll, a calculating means for calculating the current outer radius of the web roll from the detected speed of rotation of the web roll, the length of the web required for each product (such as a bag) for which the web is being used, and the number of such products to be produced per unit time, and a comparing means for activating an alarm by comparing the calculated outer radius of the roll with a comparison value determined with reference to the radius of the core shaft around which the web is wound to make the roll.

The calculating means may be adapted to calculate also the length of the web of film still remaining in the web roll, the length of time it will take to use up the remaining portion of the web currently in the web roll and the number of the products which will be made in the meantime. A display means may be included for displaying the result of such calculations by the calculating means either all at once or selectably in response to the user's instruction.

Packaging machines embodying this invention are characterized as incorporating a device as characterized above.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, components and means that are substantially the same or at least equivalent to each other are indicated by the same numeral and their structures and/or functions are not necessarily explained repetitiously.

DETAILED DESCRIPTION OF THE INVENTION

Figure 1:
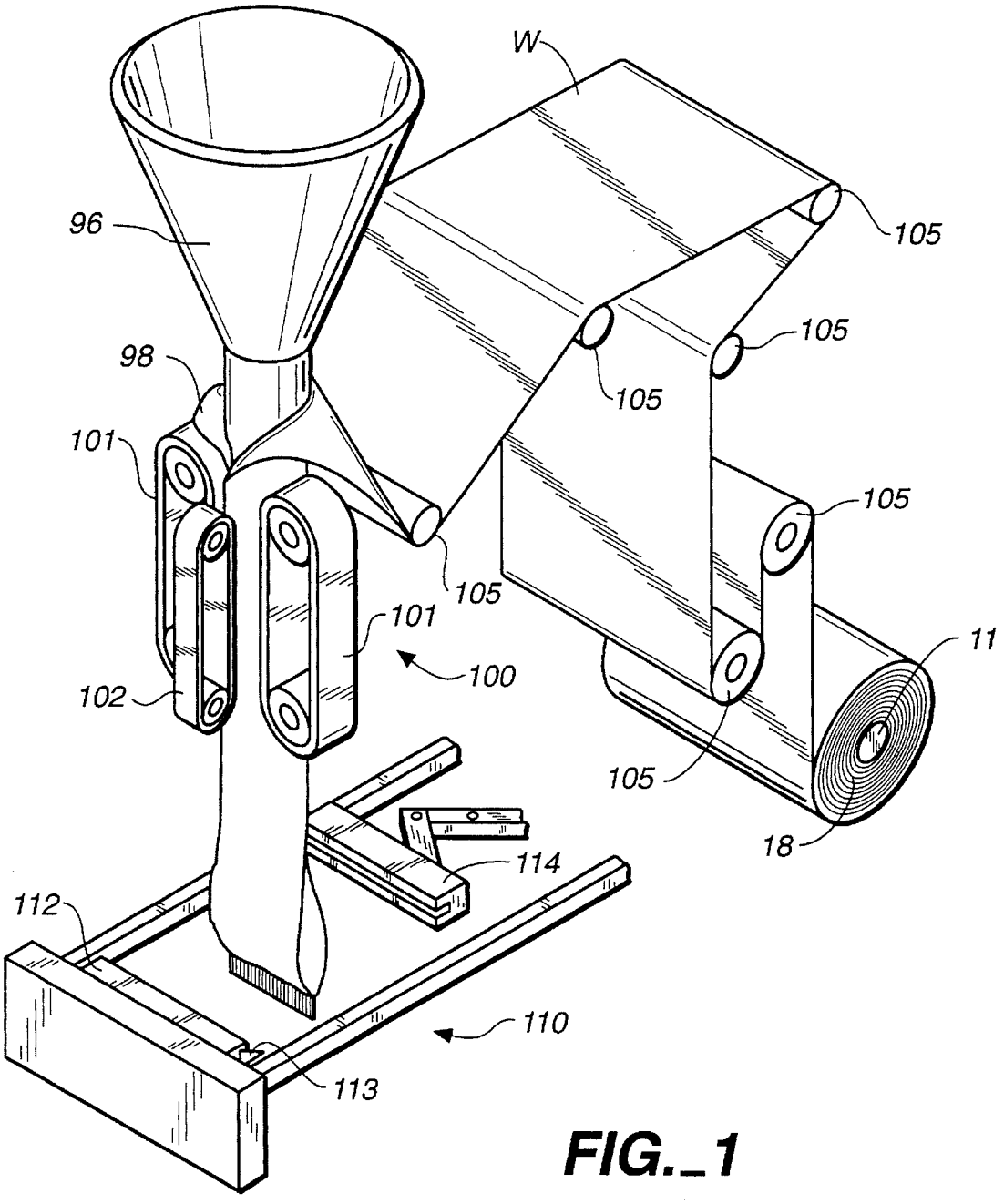
FIG. 1 is a schematic diagonal external view of a portion of a packaging machine of a form-fill-seal type which may incorporate the present invention.

The invention will be described below as incorporated in a form-fill-seal type packaging machine. For the purpose of reference, there is schematically shown in FIG. 1 a relevant portion of a packaging machine of a vertical pillow type which may incorporate the present invention, adapted to unwind a web of flexible thermoplastic film W from a web roll 18 supported around a shaft 11. The film W is guided by a plurality of guide rolls (including dancer rollers) 105 to a former 98 of a known kind. After it is thereby formed into a tubular shape, it is pulled down by a film-pulling unit 100 including a parallel-running pair of pull-down belts 101 and a longitudinal sealer in the form of a heater belt 102 for sealing together the mutually overlapping edge portions of the film W. Next, the film W, which is now in a cylindrical shape, is sealed horizontally (that is, transversely to its downward direction of motion) by a transverse sealer 110, as articles to be packaged are dropped from a hopper 96 above the former 98. The transverse sealer 110 may be of a design provided with a fixed seal jaw 112 and a mobile seal jaw 114 both of a known structure and disposed below the film-pulling unit 100. In FIG. 1, numeral 113 indicates a blade for cutting the film W transversely between the bags into which it has been formed.

Figure 2:
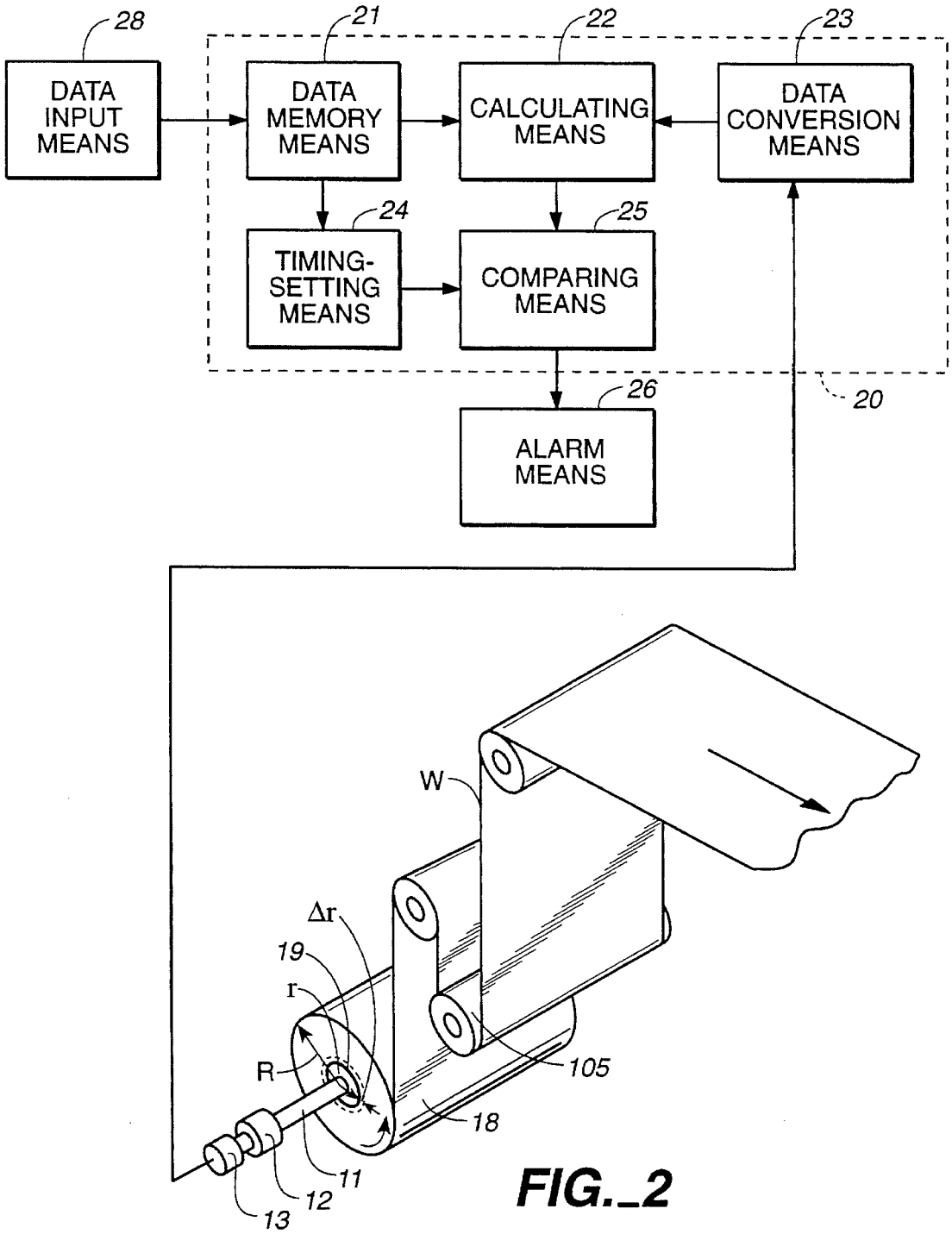
FIG. 2 is a structural diagram of a warning device embodying the invention including a block diagram of its control unit.

FIG. 2 shows a warning device according to this invention, which may be used in connection with the packaging machine described above with reference to FIG. 1 and may be characterized as having a servo motor 12 for rotating the shaft 11 while maintaining a uniform tension inside the film W and a revolution counter 13 connected to the shaft 11 for counting the number of its rotation per unit time ω. The revolution counter 13 is connected to a control unit 20 which, in turn, is connected to a warning means 26 and a data input means 28 such as a control panel.

Data, such as the unit length L of the film W required to form a bag by the packaging machine, the capability of the packaging machine such as the number N of bags (or packaged products using these bags) that can be produced thereby per unit time, and the core radius r of the web roll, are adapted to be inputted through the data input means 28 into a data memory means 21 and stored therein. These data, temporarily stored in the data memory means 21, are outputted both to a calculating means 22 and to a timing-setting means 24.

The timing-setting means 24 is for setting the timing at which the warning means 26 is to be activated and is adapted to add a predetermined incremental value Δr to the value of the core radius r inputted through the data input means 28 and to output a signal indicative of the value of r+Δr to a comparing means 25.

When the packaging machine is activated after these data are inputted through the data input means 28, the web roll 18 is rotated by the servo motor 12, unwinding the film W out towards the former 98. The rotational speed of the web roll 18 is detected by the revolution counter 13 connected to the shaft 11 and signals indicative of the rotational speed of the web roll 18 detected by the revolution counter 13 are converted into digital signals by a data conversion means 23 in the control unit 20. The digital signal indicative of the number of rotation per unit time ω of the shaft 11 (and hence also of the web roll 18) is inputted to the calculating means 22.

The calculating means 22, by receiving the data L and N from the data memory means 21 as explained above as well as the digital data ω from the data conversion means 23, calculates the outer radius R of the web roll 18 according to the formula R=LN/πω and outputs this calculated value of the outer radius R to the comparing means 25.

The comparing means 25 serves to compare the calculated value of the outer radius R of the web roll 18 received from the calculating means 22 and the value of r+Δr received from the timing-setting means 24 and to activate the warning means 26 if the value of the outer radius R reaches the value r+Δr, indicating that the total thickness of the layer of film in the web roll 18 has been reduced to only Δr and hence that the film W remaining in the web roll 18 will be used up soon. The warning means 26 may comprise a buzzer which can be sounded or a warning lamp which can be lit up when activated in response to an activation signal received from the comparing means 25. When web rolls 18 having a common core 19 (with outer radius of r) are used, the function of the timing-setting means 24 may be simply to output to the comparing means 25 the value r+Δr.

Figure 3:
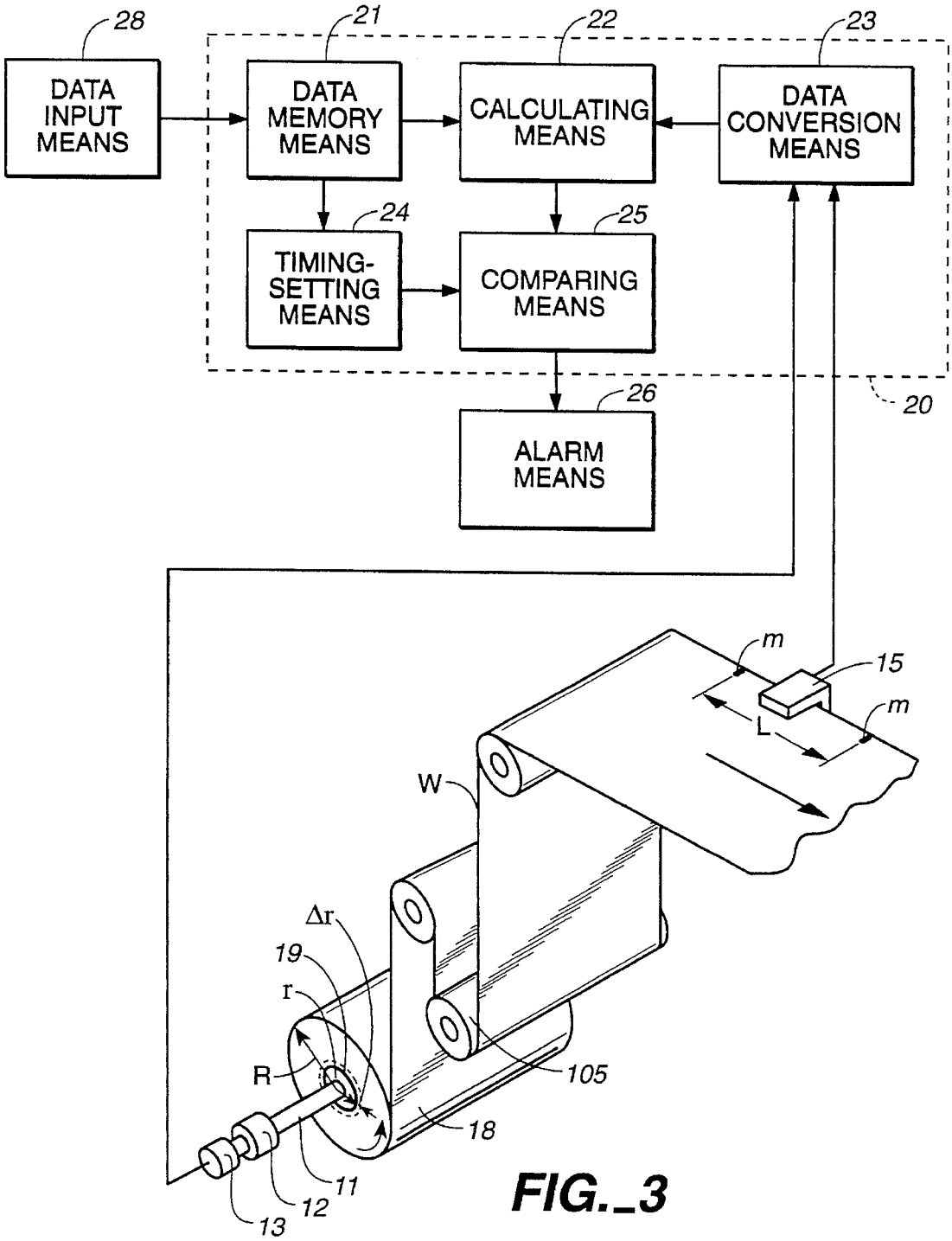
FIG. 3 is a structural diagram of another warning device embodying the invention including a block diagram of its control unit.

FIG. 3 shows another warning device according to the present invention incorporated in the same packaging machine as described above with reference to FIGS. 1 and 2. This warning device is applicable where the number of bags that can be produced per unit time is either unknown or uncertain, and is characterized as comprising an eye-mark sensor 15 of a kind used, for example, for timing adjustment, and using it as means for detecting the speed of motion of the film W.

The film W has eye marks m printed thereon at uniform intervals L longitudinally, indicative of the length of the film W required to produce a bag by the packaging machine. Both the number n of detection pulses outputted from the eye-mark sensor 15 per unit time and the rotational speed e of the shaft 11 detected by the revolution counter 13 connected thereto are transmitted to the data conversion means 23. The user inputs the length L and, if necessary, the radius r of the core 19 for supporting the web roll 18 through the data input means 28. These data are received by the calculating means 22 and the timing-setting means 24 as explained above with reference to FIG. 2, and the calculating means 22 calculates the current value of the outer radius R of the web roll 18 by the formula R =Ln/πω. The comparing means compares the value R thus obtained with the value r+Δr set by the timing-setting means 24 as explained above.

Figure 4:
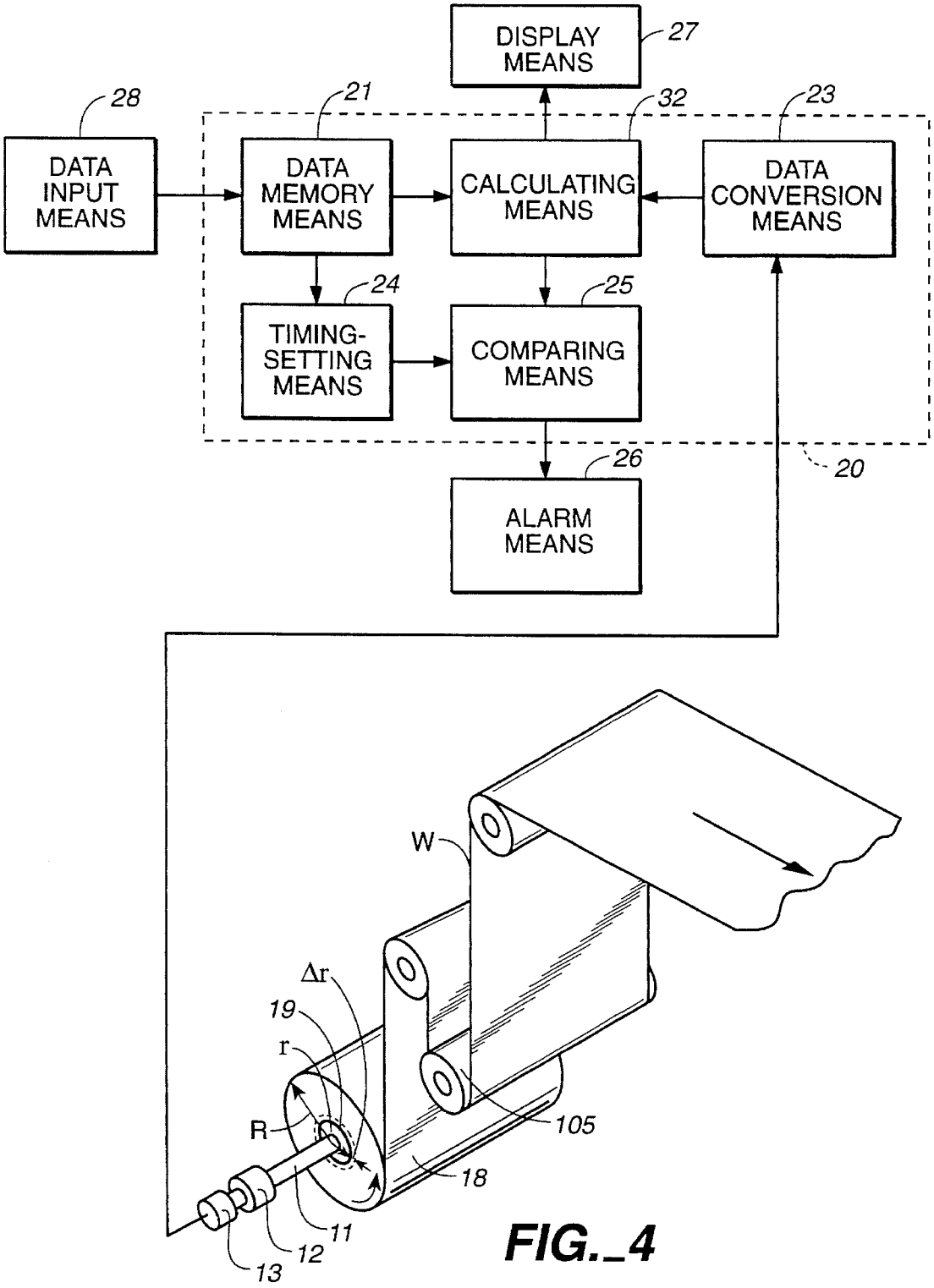
FIG. 4 is a structural diagram of a monitoring device embodying the invention including a block diagram of its control unit.

FIG. 4 shows a monitoring device according to this invention which may be used in connection with the packaging machine described above with reference to FIG. 1. This device is structured and functions similarly to the warning device described above with reference to FIG. 2 except that the thickness t of the film W is inputted into its control unit 30 through the data input means 28 and is temporarily stored in the data memory means 21 and that its calculating means 32 is adapted to calculate not only the outer radius R of the web roll 18 according to the formula R =LN/πω by using data received from the data memory means 21 and the data conversion means 23, but also the number of windings n of the film W currently remaining in the web roll 18 by the formula n=(R−r)/t. Because the length $L_r$ of the film W remaining in the web roll 18 at this moment may be given approximately by the formula:

$$L_r = 2\pi \sum_{i=1}^{n} (r + 2it),$$

the calculating means 32 calculates this value as follows:

$$L_r=(R-r)\{(R-r+t)+rt\}\pi/t.$$

From the value of $L_r$ thus obtained, as well as the values of L and N received from the data memory means 21, the calculating means 32 also calculates as follows the remaining time $t_r$ in which the remaining portion of the film W currently in the roll 18 would be used up, as well as the number of bags f which can be made with this remaining portion of the film W:

$$t_r=L_r/(LN), \text{ and}$$

$$f=L_r/L.$$

The timing-setting means 24 and the other components shown in FIG. 4 are structured and function similarly as explained above with reference to FIG. 2.

Figures 5, 6A, 6B:
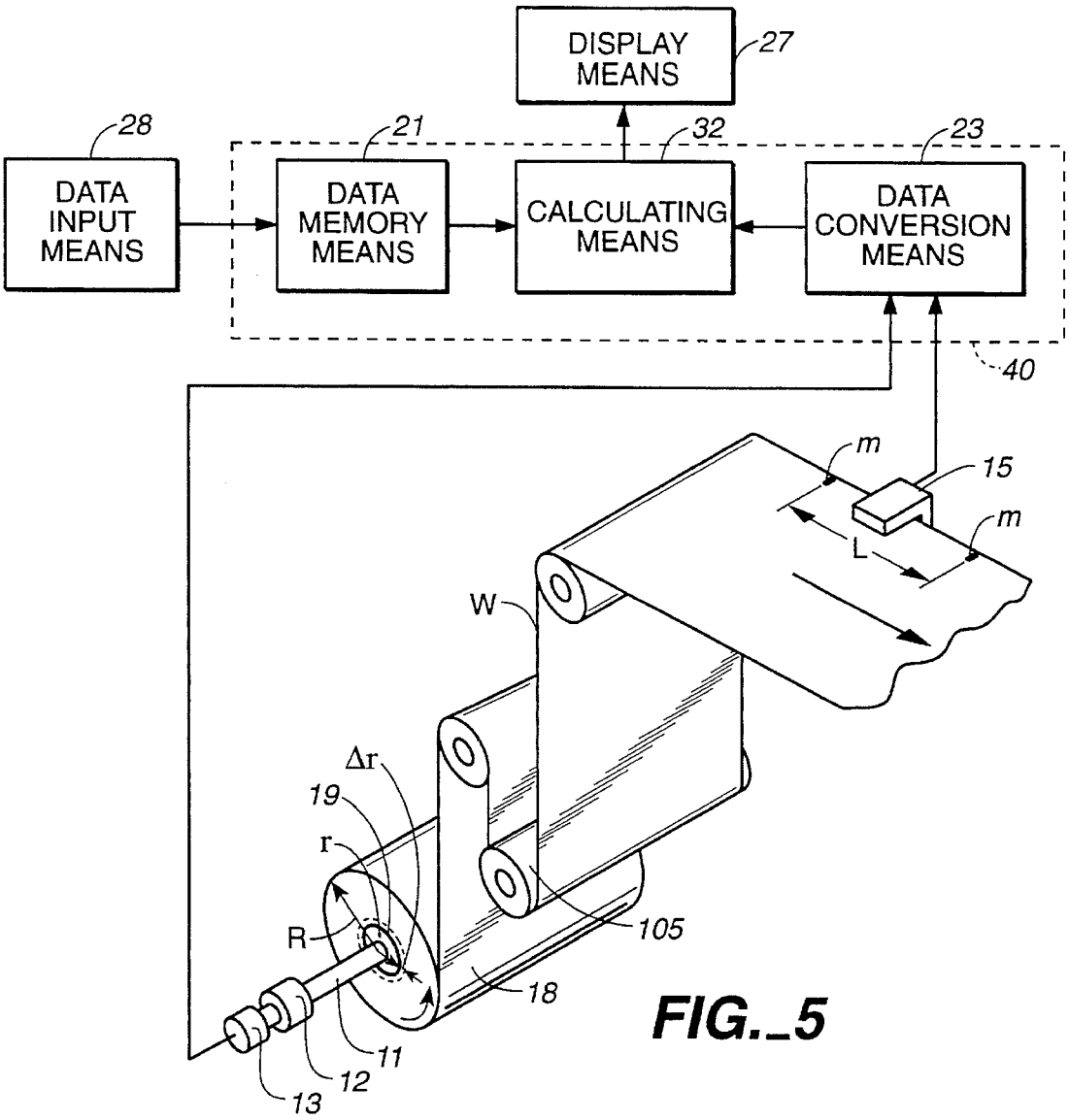
FIG. 5 is a structural diagram of another monitoring device embodying the invention including a block diagram of its control unit.
FIGS. 6A and 6B are examples of displays that may be made on the display means.

The values of $L_r$, $t_r$ and f thus calculated by the calculating means 32 may be displayed simultaneously on the display means 27, for example, as shown in FIG. 6A. Alternatively, the control unit 30 may be so designed that a display will be made as shown in FIG. 6B to allow the user to operate on the data input means 28 and to thereby specify which of the calculated data should be displayed on the display means 27.

FIG. 5 shows another monitoring device embodying the invention incorporated in the same packaging machine as described above with reference to FIG. 1. This monitoring device, like the warning device described above with reference to FIG. 3, is applicable where the number of bags that can be produced per unit time is either unknown or uncertain. Its structure and the functions of the components of its control unit 40 are identical to the descriptions given above with reference to FIGS. 3 and 4.

The invention has been described above with reference to only a limited number of examples, but these examples are not intended to limit the scope of the invention. It is to be understood that many modifications and variations are possible within the scope of this invention. For example, displays to be made on the display means need not be in the format shown in FIG. 6A or 6B. Data may be displayed not only numerically but also by means of bar graphs or circular graphs. It is also to be remembered that warning devices and monitoring devices according to this invention need not be used in combination with a packaging machine of a form-fill-seal type. They may be used in combination with a machine of any kind which steadily uses up an elongated film-like thin material in the form of a web wound around a core shaft to form a web roll.

In summary, the amount of the web remaining on a web roll, from which the web is steadily being pulled out, can be displayed according to this invention without using any detector or sensor for directly measuring the outer radius of the web roll. A warning signal can be outputted when the remainder becomes small and reaches a predefined level. This allows the user to accurately plan for the next exchange of rolls or to establish a production plan involving the use of web rolls.

What is claimed is:

1. A monitoring device in combination with a web roll having a web wound around a core shaft and rotating to thereby cause said web to unwind therefrom, said monitoring device comprising:

rotation detecting means for detecting speed of rotation $\omega$ of said web roll;

display means for displaying information thereon; and calculating means for using said speed of rotation $\omega$ detected by said rotation detecting means, a unit length L of said web required for a product and a number N of times said unit length L of said web is pulled out of said web roll per unit time, thereby calculating an outer radius value R indicative of the current outer radius of said web roll, and causing numbers calculated by said calculating means to be displayed on said display means.

2. The monitoring device of claim 1 wherein said calculating means further calculates a remaining length value $L_r$ from said outer radius value R, a core shaft radius value r which is indicative of an outer radius of said core shaft, and a thickness value t indicative of the thickness of said web, said remaining length value $L_r$ being indicative of the length of said web currently remaining in said web roll.

3. The monitoring device of claim 2 wherein said calculating means further calculates a remaining time value $t_r$ at least from said remaining length value $L_r$, said remaining time value $t_r$ being indicative of the time in which said web currently remaining in said web roll is expected to be used up.

4. The monitoring device of claim 3 wherein said calculating means further calculates a bag number value f at least from said remaining length value $L_r$, said bag number value f being indicative of the number of said products expected to be producible with said web currently remaining in said web roll.

5. The monitoring device of claim 4 further comprising means for causing at least one selected from said outer radius value R, said remaining length value $L_r$ and said bag number value f to be selectably displayed on said display means.

6. The monitoring device of claim 1 wherein said web is provided with eye-marks having uniform longitudinal separations therebetween, said monitoring device further comprising an eye-mark sensor disposed on travel path of said web for detecting said eye-marks provided on said web, said calculating means being further adapted to calculate said number N from results of detections by said eye-mark sensor and said rotation detecting means.

7. The monitoring device of claim 2 wherein said remaining length value $L_r$ is calculated by the formula: $L_r=(R-r)\{(R-r+t)+rt\}\pi/t$.

8. The monitoring device of claim 3 wherein said remaining time value $t_r$ is calculated by the formula: $t_r=L_r/(LN)$.

9. The monitoring device of claim 4 wherein said bag number value f is calculated by the formula: $f=L_r/L$.

10. The monitoring device of claim 1 further comprising:

data input means for allowing a user to input data indicative of said unit length L and said product number N; and memory means for storing said data inputted through said data input means.

11. A warning device in combination with a web roll having a web wound around a core shaft and rotating to thereby cause said web to unwind therefrom, said warning device comprising:

rotation detecting means for detecting speed of rotation $\omega$ of said web roll;

calculating means for using said speed of rotation $\omega$ detected by said rotation detecting means, a unit length L of said web required for a product and a number N of times said unit length L of said web is pulled out of said web roll per unit time, thereby calculating an outer radius value R indicative of the current outer radius of said web roll; and comparing means for determining a comparison value based on a core shaft radius value r indicative of the outer radius of said core shaft, making a comparison between said comparison value and said outer radius value R, and causing an alarm signal to be outputted based on the result of said comparison.

12. The warning device of claim 11 wherein said web is provided with eye-marks having uniform longitudinal separations therebetween, said warning device further comprising an eye-mark sensor, disposed on travel path of said web for detecting said eye-marks provided on said web, said calculating means being further adapted to calculate said number N from results of detections by said eye-mark sensor and said rotation detecting means.

13. A packaging machine comprising:

a web supporting means supporting a web roll having a web of a bag-making material wound around a core shaft;

a former for forming said web into a tubular shape;

web guiding means for guiding said web from said web roll to said former and said tubularly formed web in a longitudinal direction;

a longitudinal sealer for sealing side edges of said tubularly formed web together in said longitudinal direction;

a transverse sealer having a pair of sealing means for compressing and sealing sheets of said tubularly formed web together therebetween transversely to said longitudinal direction and thereby forming a bag;

rotation detecting means for detecting speed of rotation ω of said web roll;

display means for displaying information thereon; and calculating means for using said speed of rotation ω detected by said rotation detecting means, a unit length L of said web required for a product and a number N of times said unit length L of said web is pulled out of said web roll per unit time, thereby calculating an outer radius value R indicative of the current outer radius of said web roll, and causing numbers calculated by said calculating means to be displayed on said display means.

14. The packaging machine of claim 13 wherein said calculating means further calculates a remaining length value $L_r$ from said outer radius value R, a core shaft radius value r which is indicative of an outer radius of said core shaft, and a thickness value t indicative of the thickness of said web, said remaining length value $L_r$ being indicative of the length of said web currently remaining in said web roll.

15. The monitoring device of claim 14 wherein said calculating means further calculates a remaining time value $t_r$ at least from said remaining length value $L_r$, said remaining time value $t_r$ being indicative of the time in which said web currently remaining in said web roll is expected to be used up.

16. The monitoring device of claim 15 wherein said calculating means further calculates a bag number value f at least from said remaining length value $L_r$, said bag number value f being indicative of the number of said products expected to be producible with said web currently remaining in said web roll.

17. The monitoring device of claim 16 further comprising means for causing at least one selected from said outer radius value R, said remaining length value $L_r$ and said bag number value f to be selectably displayed on said display means.

18. The monitoring device of claim 13 wherein said web is provided with eye-marks having uniform longitudinal separations therebetween, said monitoring device further comprising an eye-mark sensor disposed on travel path of said web for detecting said eye-marks provided on said web, said calculating means being further adapted to calculate said number N from results of detections by said eye-mark sensor and said rotation detecting means.

19. A packaging machine comprising:

a web supporting means supporting a web roll having a web of a bag-making material wound around a core shaft;

a former for forming said web into a tubular shape;

web guiding means for guiding said web from said web roll to said former and said tubularly formed web in a longitudinal direction;

a longitudinal sealer for sealing side edges of said tubularly formed web together in said longitudinal direction;

a transverse sealer having a pair of sealing means for compressing and sealing sheets of said tubularly formed web together therebetween transversely to said longitudinal direction and thereby forming a bag;

rotation detecting means for detecting speed of rotation ω of said web roll;

calculating means for using said speed of rotation ω detected by said rotation detecting means, a unit length L of said web required for a product and a number N of times said unit length L of said web is pulled out of said web roll per unit time, thereby calculating an outer radius value R indicative of the current outer radius of said web roll; and comparing means for determining a comparison value based on a core shaft radius value r indicative of the outer radius of said core shaft, making a comparison between said comparison value and said outer radius value R, and causing an alarm signal to be outputted based on the result of said comparison.

20. The warning device of claim 19 wherein said web is provided with eye-marks having uniform longitudinal separations therebetween, said warning device further comprising an eye-mark sensor, disposed on travel path of said web for detecting said eye-marks provided on said web, said calculating means being further adapted to calculate said number N from results of detections by said eye-mark sensor and said rotation detecting means.

* * * * *